US007922364B2

(12) United States Patent
Tessnow et al.

(10) Patent No.: US 7,922,364 B2
(45) Date of Patent: Apr. 12, 2011

(54) LED LAMP ASSEMBLY

(75) Inventors: Thomas Tessnow, Weare, NH (US); Kim Albright, Warner, NH (US); Michael Tucker, Henniker, NH (US)

(73) Assignee: OSRAM SYLVANIA, Inc., Danvers, MA (US)

( * ) Notice: Subject to any disclaimer, the term of this patent is extended or adjusted under 35 U.S.C. 154(b) by 238 days.

(21) Appl. No.: 12/401,233

(22) Filed: Mar. 10, 2009

(65) Prior Publication Data

US 2010/0232164 A1 Sep. 16, 2010

(51) Int. Cl.
*F21V 29/00* (2006.01)

(52) U.S. Cl. ..... 362/294; 362/373; 362/249.02; 362/249.11; 362/800

(58) Field of Classification Search ..... 362/249.02, 362/249.11, 373, 294
See application file for complete search history.

(56) References Cited

U.S. PATENT DOCUMENTS

| | | | | |
|---|---|---|---|---|
| 4,978,638 | A | 12/1990 | Buller et al. | |
| 5,495,392 | A | 2/1996 | Shen | |
| 5,930,116 | A | 7/1999 | Palmer | |
| 6,025,863 | A | 2/2000 | Nakajima et al. | |
| 6,308,772 | B1 | 10/2001 | Obara et al. | |
| 6,991,355 | B1 | 1/2006 | Coushaine et al. | |
| 7,110,656 | B2 | 9/2006 | Coushaine et al. | |
| 7,261,452 | B2 | 8/2007 | Coushaine et al. | |
| 7,806,562 | B2 * | 10/2010 | Behr et al. | 362/294 |
| 2005/0243559 | A1 | 11/2005 | Coushaine et al. | |
| 2007/0047251 | A1 | 3/2007 | Sanroma et al. | |
| 2007/0070645 | A1 | 3/2007 | Coushaine et al. | |
| 2008/0285271 | A1 * | 11/2008 | Roberge et al. | 362/235 |
| 2008/0310119 | A1 | 12/2008 | Giacoma | |
| 2009/0034283 | A1 | 2/2009 | Albright et al. | |

FOREIGN PATENT DOCUMENTS

WO WO2009018436 2/2009

OTHER PUBLICATIONS

The Osram Sylvania "L3-A LED lamp sample", previously filed Feb. 17, 2010 with accompanying description in Second Information Disclosure.

* cited by examiner

*Primary Examiner* — Anabel M Ton
(74) *Attorney, Agent, or Firm* — Edward S. Podszus

(57) ABSTRACT

An LED lamp assembly with a substantial heat sink may be inexpensively constructed using sections of extruded metal as the heat sink. The extruded heat sink sections are trapped in latched sandwich structure assuring good thermal contact between the LED light sources and the extruded heat sink and a metal optic. The inexpensive structure may be rapidly assembled.

9 Claims, 5 Drawing Sheets

LED LAMP ASSEMBLY

CROSS-REFERENCE TO RELATED APPLICATIONS

BACKGROUND OF THE INVENTION

1. Field of the Invention

The invention relates to electric lamps and particularly to electric lamps. More particularly the invention is concerned with LED lamps with heat sinks.

2. Description of the Related Art Including Information Disclosed Under 37 CFR 1.97 and 1.98

LED lamps are quickly becoming economical. They however frequently require large heat sinks to increase their lumen efficiency and to preserve their longevity. Heat sinks are expensive to design and to make. Moreover, the radiating fins, pins or other heat conducting elements are frequently fragile, or awkward to position on a lamp exterior. There is then a need to for a simple heat sink structure that is inexpensive to make, and practical to couple to an LED assembly.

BRIEF SUMMARY OF THE INVENTION

An LED lamp assembly can be economically made with an extruded heat sink. The assembly includes a planar circuit board having a first side and a second side. One or more LEDs are supported on the circuit board to emit light along a path directed away from the first side. A heat sink having a front face is positioned to be adjacent the second side of the circuit board. The heat sink has at least one radiating element extending away from the front face. A back plate has a back wall including an interior wall defining an opening to receive the at least one radiating element, and has at least one latch. An optic is extended through the printed circuit board, the optic having a light receiving face positioned to substantially intersect light emitted from the one or more LEDs. The optic has a portion positioned intermediate the second side of the printed circuit board and the heat sink. A front plate has an inner wall defining a passage and has a latch. The back plate is latched to the front plate, trapping the circuit board and the intermediate portion of the optic in close thermal contact with the front face of the heat sink. Meanwhile, the radiating element extends through the back plate and with the radiating element substantially exposed on the exterior of the lamp assembly.

DETAILED DESCRIPTION OF THE INVENTION

Figure 1:
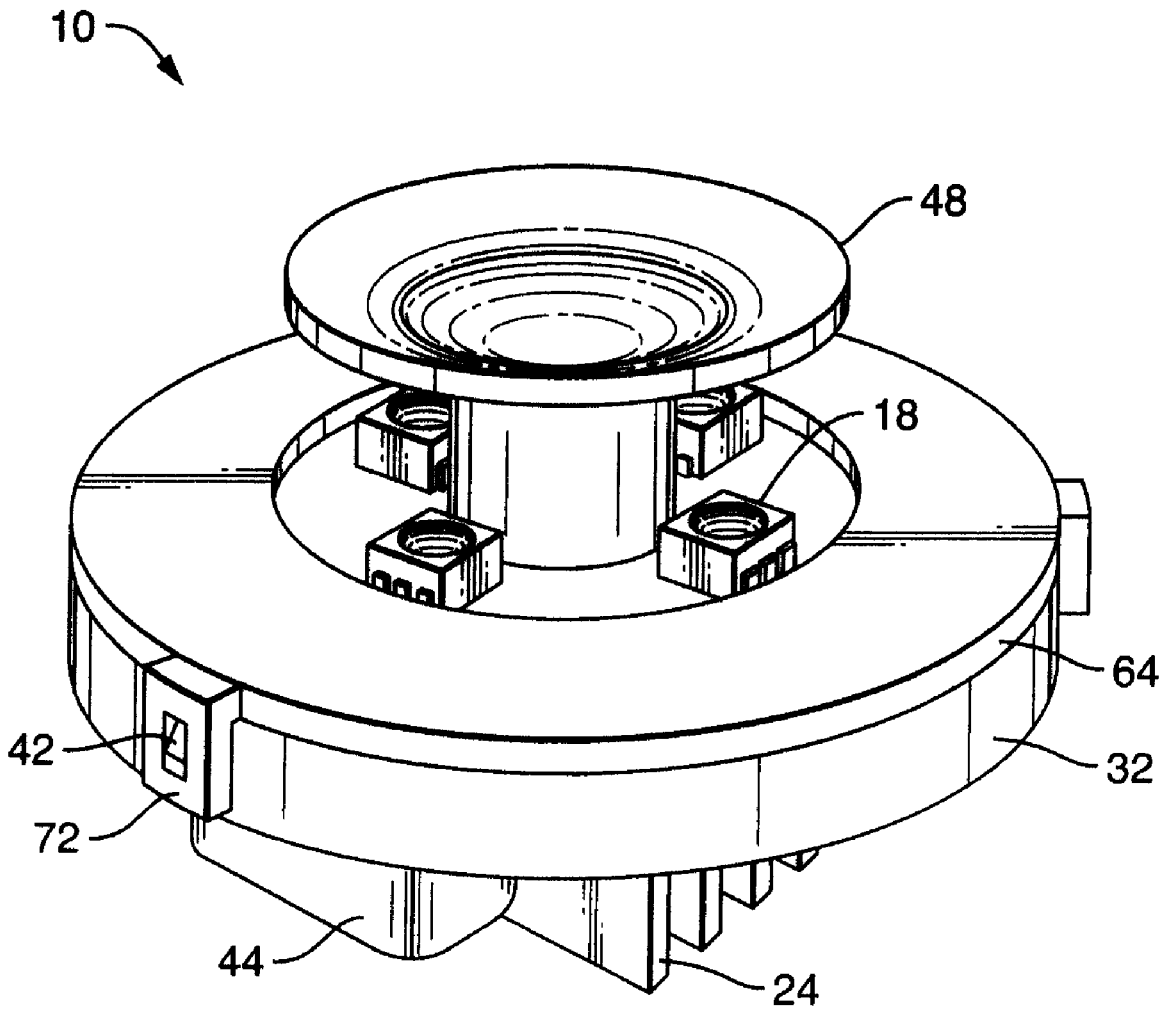
FIG. 1 shows a front perspective view of a preferred embodiment of an LED Lamp Assembly.

FIG. 1 shows a front perspective view of a preferred embodiment of an LED Lamp Assembly 10. The LED lamp assembly 10 is constructed with a circuit board 12, one or more LEDs 18, an electrical connector 20, a heat sink 24, a back plate 32, an optic 48, and a front plate 64.

Figure 3:
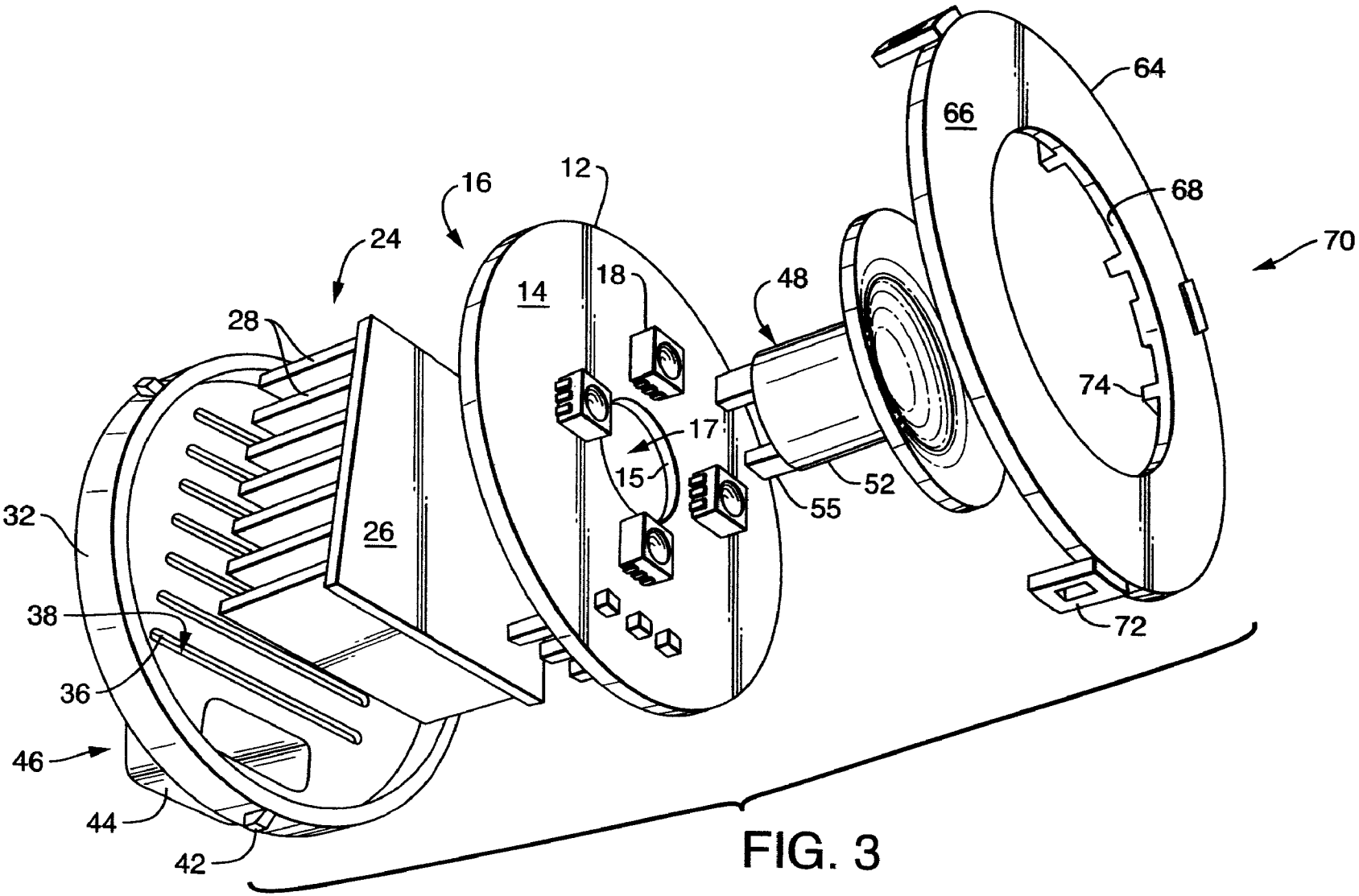
FIG. 3 shows an exploded front view of a preferred embodiment of an LED Lamp Assembly.
Figure 4:
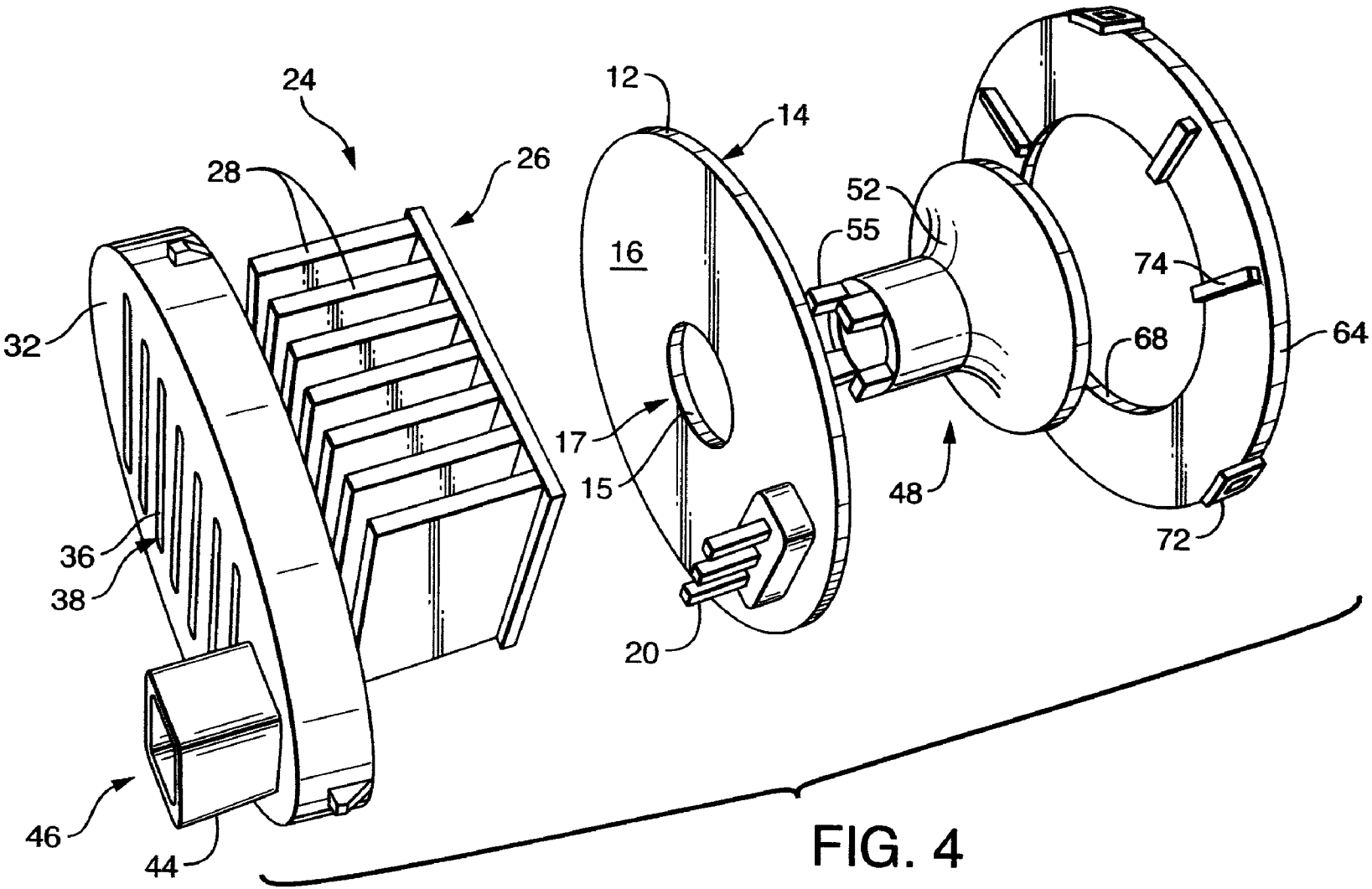
FIG. 4 shows an exploded rear view of a preferred embodiment of an LED Lamp Assembly.

FIG. 3 shows an exploded front view of a preferred embodiment of an LED Lamp Assembly 10. FIG. 4 shows an exploded rear view of a preferred embodiment of an LED Lamp Assembly 10. The circuit board 12 is a generally planar body with a first side 14 and a second side 16. Formed in the circuit board is an inner wall 15 enclosing a through passage 17. The preferred through passage 17 is sized and shaped to snuggly receive an end portion of the optic 48. The circuit board 12 supports on the first side 14 one or more LEDs 18 that emits light along a path directed away from the first side 14 towards the optic 48. Supported on the circuit board 12 is electrical circuitry. The electrical circuitry may provide appropriate power and signal conditioning to the supplied electrical power that is then used to operate the LEDs 18. In the preferred embodiment circuit board 12 electrically connects the LEDs 18 to the electrical connector 20 to receive electrical power to drive the LEDs 18. The electrical connector 20 is preferably mechanically and electrically coupled to the circuit board 12 and circuitry assembly. In an alternative, the second side of the circuit board 12 may be formed with recesses or protrusions to receive or mate with the tabs of the optic 48.

The heat sink 24 is formed from material with high thermal conductivity, such as a metal, like copper, aluminum, zinc or others. The heat sink 24 has a planar front face 26 that is positioned to be in close thermal contact with the second side 16 of the circuit board 12. The back side of the heat sink 24 may be formed with one or more ribs or troughs that may couple with corresponding features on the circuit board 12 thereby aligning one with the other. The preferred heat sink 24 a plurality of radiating elements 28 extending perpendicularly away from the planar face 26. In the preferred embodiment, a plurality of fins 28 extend at 90 degrees to the front face 26, this enables the exterior back plate to be axially slipped over the radiating fins. Extrusions are inexpensive to make, and redesigning an extruded heat sink to change the fin length, fin width, fin spacing or front side dimensions for differing circuit board, optic, back cover, or exterior limitations can be rapidly accommodated. Extruded heat sinks can be robust. It has also been found that an extruded body has a higher thermal conductivity than has a cast or molded material. For example, extruded aluminum has a thermal conductivity of about 200 W/mK, but a cast aluminum alloy has a thermal conductivity of less than 100 W/mK. Extruding the metal heat sink 24 also greatly reduces the cost of producing the heat sink 24. The extruded heat sink 24 with a planar front face 26 can be cut along a peripheral line perpendicular to the front face 26. The easiest cut is straight across the extrusion in two places, leaving a heat sink in the general form of a rectangular block, or polypiped. The extruded heat sink 24 then has a constant cross section taken perpendicular to the direction of extrusion, and has a first perpendicular end and a second perpendicular end. Alternatively the exterior line may be circular, or otherwise thereby forming a cylindrical, oval or other useful shape. In a further alternatively, the front face 26 of the heat sink 24 may be modified with alignment features, such as recesses or protrusions to receive and align printed circuit board 12 or the optic 48 when the group is pressed into contact.

Figure 2:
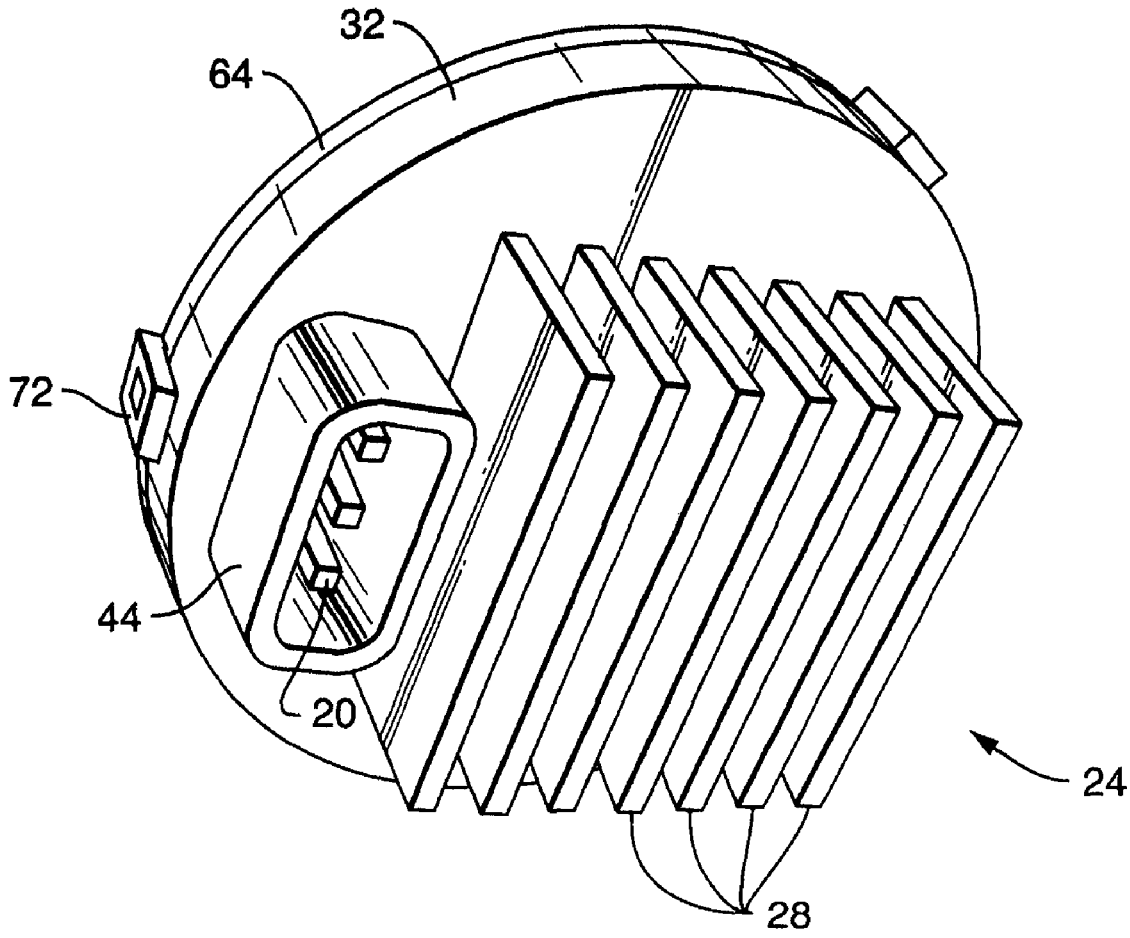
FIG. 2 shows a rear perspective view of a preferred embodiment of an LED Lamp Assembly.

The back plate 32 is designed to provide pressure against the heat sink 24 in the direction of the circuit board 12. The back plate 32 has a back wall 34 including one or more first interior walls 36 defining one or more openings 38. The openings 38 are sized and shaped to receive respectively one or more radiating elements 28. The respective radiating element or elements 28 may then be interdigitated with respective openings 38 formed in the back plate 32, and extend through the back plate 32 to the exterior for exposure on the exterior of the lamp assembly 10. Formed on the back plate 32 are a side wall that has at least one latch 42, and a second wall 44 defining at least in part an opening 46 to receive the electrical connector 20, thereby forming a socket portion 46. FIG. 2 shows a rear perspective view of a preferred embodiment of an LED Lamp Assembly.

Figure 5:
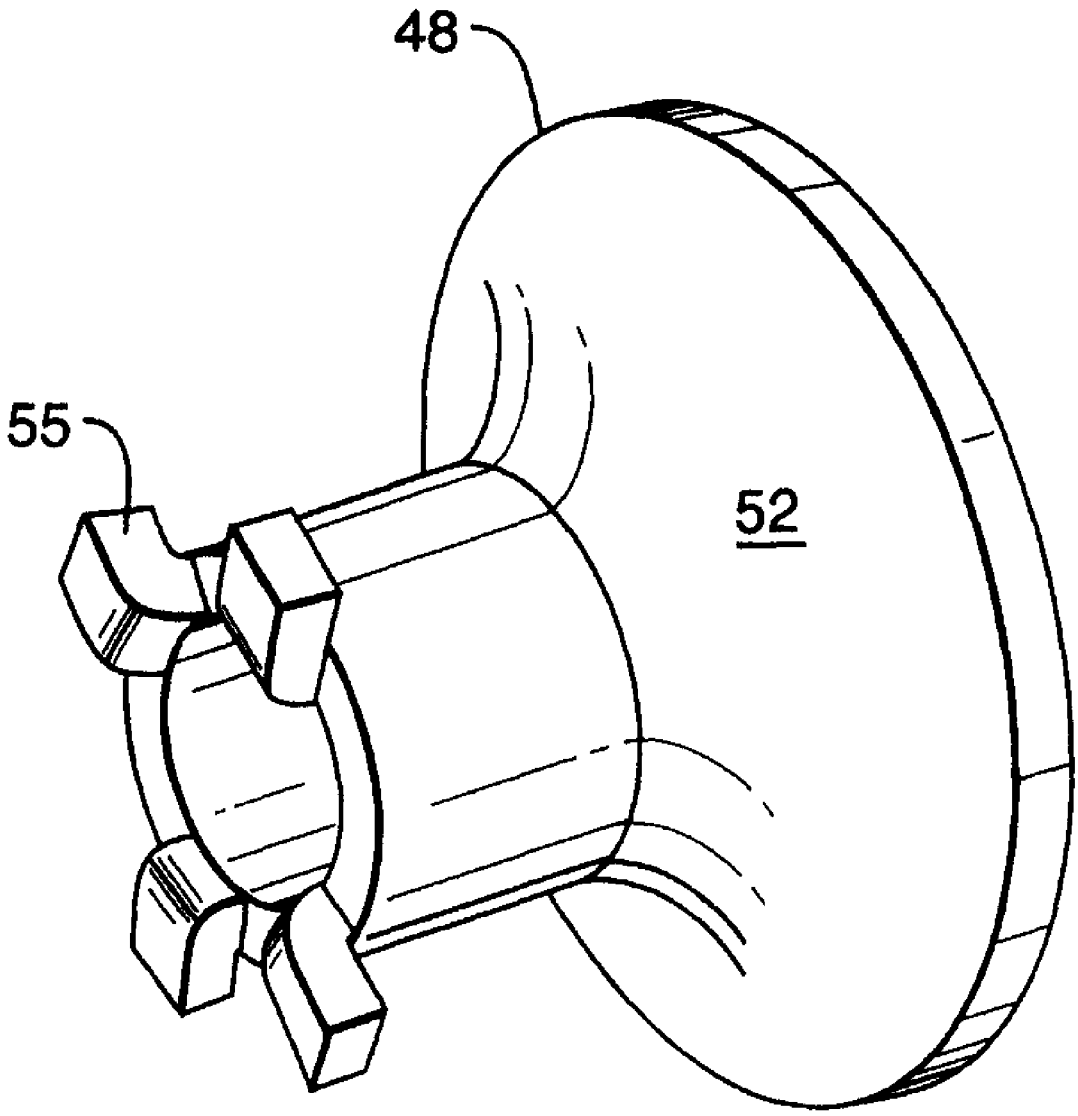
FIG. 5 shows a perspective view of a reflective optic with the tabs bent.

FIG. 5 shows a perspective view of a reflective optic 48 with the tabs 55 bent. The optic 48 is preferably mechanically coupled to the printed circuit board 12. The preferred optic 48 has a light reflecting surface, and a light receiving face 50 substantially spanning, and intersecting the light path. The optic 50 is mechanically inserted in the hole formed in the circuit board and coupled to the circuit board 12; the optic 48 is a metal body of revolution having a side wall 52 with at least a portion of the side wall 52 being reflective. The preferred optic 48 is a stamped metal sheet in the form of a trumpet, the outer surface of which is reflective, and shaped to reflect light perpendicular to the lamp axis, so the light may be further intercepted by a forward directing reflector. The preferred optic 48 has a thermal contact 54 pressed against either the printed circuit board 12 or the heat sink 24. The preferred optic 48 is made of metal, and has a thermal contact 54 trapped under mechanical pressure pressed between the printed circuit board 12 and the heat sink 24. In one embodiment, the rear facing end of the optic 48 is formed with one or more tabs 55. Preferably the tabs 55 are equally distributed around the rear facing end of the trumpet shaped optic. Once the optic 48 is inserted into the hole formed in the circuit board, the tabs 55 may be bent outwardly at 90 degrees, to trap the optic 48 in the circuit board hole. In the preferred embodiment the cone portion of the optic is small enough in diameter to pass through a passage formed in the front plate 64, but large enough in diameter to span the axial projection of the one or more LEDS to substantially intercept the light emitted by the one or more LEDS.

The front plate 64 has a planar face 66, an inner wall 68 defining a passage 70 sufficiently large and otherwise shaped to fit over the optic 48, and sufficiently spaced away from the LEDs 18 to not interfere with the light emitted by the LEDs 18 in the direction of the reflective surface of the optic 48. The front plate 64 is further formed with at least one latch portion 72 to couple with a corresponding latch portion formed on the back plate 32. For example, the front plate 64 may be formed as an annulus with one or more peripheral latch tabs 72. The inner side of the front plate 64 may be formed with nubs or stand offs 74 sized and positioned to mate with areas of the circuit board 12, so that the front plate 64 may mate with and press against the circuit board 12.

The LED lamp assembly is assembled by positioning the heat sink 24 in the back plate 32. The optic 48 is inserted through the hole in the circuit board 12 and the tabs 55 are bent radially away from the axis to trap the optic 48 in the circuit board 12. The second side of the circuit board 12 may be placed against the flat face of the heat sink 24. It is understood that the electrical integrity of the printed circuit board 12 should be preserved, so an interfacing layer of a thermally conductive, but electrically insulating layer such as a lacquer, silicone, or similar thin layer of material may be interposed. The electrical connectors 20 are aligned and positioned in the socket portion 46. The bent tabs 55 are then trapped between the front face 26 of the heat sink 24 and the second side 16 of the circuit board 12. The front plate 64 is passed over the forward end of the optic 48, and aligned to latch with the back plate latches 42. The front plate 64 or the standoffs (numbs) 74 of the front plate 64, as the case may be, press against the circuit board 12, pressing the circuit board 12, and captured tabs 55 in close thermal contact with the heat sink 24. The latches 72 of the front plate 64 couple with the latches 42 of the back plate 32 retaining the assembly in tight contact.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An LED lamp assembly comprising:

a planar circuit board having a first side and a second side;

one or more LEDs supported on the circuit board to emit light along a path directed away from the first side;

a heat sink having a front face adjacent the second side of the circuit board and having at least one radiating element extending away from the front face;

a back plate having a hack wall including an interior wall defining an opening receiving the at least one radiating element, and having at least one latch;

an optic extended through the printed circuit board, the optic having a light receiving face positioned to substantially intersect light emitted from the one or more LEDs, the optic having a portion positioned intermediate the second side of the printed circuit board and the heat sink; and a front plate having an inner wall defining a passage and having a latch;

the back plate being latched to the front plate, trapping the circuit board and the intermediate portion of the optic in close thermal contact with the front face of the heat sink, with the radiating element extended through the back plate and with the radiating element substantially exposed on the exterior of the lamp assembly.

2. The lamp assembly in claim 1, where in the heat sink has a plurality of radiating elements and the back plate has a corresponding plurality of defined openings, the respective radiating elements being interdigitated with the respective openings for exposure on the exterior of the lamp assembly, while providing pressure against the heat sink in the direction of the circuit board.

3. The lamp assembly in claim 1, where in the optic is a body of revolution having a side wall with at least a portion of the side wall being reflective.

4. The lamp assembly in claim 1, wherein the optic is made of metal, and has a thermal contact pressed against the either the printed circuit board or the heat sink.

5. The lamp assembly in claim 1, wherein the optic is made of metal, and has a thermal contact pressed between the printed circuit board and the heat sink.

6. The lamp assembly in claim 1, wherein the heat sink is a linearly extended body having a planar surface on a first side and a plurality of ribs extending perpendicular to the first side, the heat sink otherwise having a constant cross section having a first perpendicular end and a second perpendicular end.

7. The lamp assembly in claim 6, wherein the heat sink defines a rectangular polypiped.

8. The lamp assembly in claim 6, wherein the heat sink defines a circular cylindrical body.

9. An LED lamp assembly comprising:

a planar circuit board having a first side and a second side;

one or more LEDs supported on the circuit board to emit light along a path directed away from the first side;

an electrical connector coupled to the circuit board;

a heat sink having a front face in close thermal contact with the second side of the circuit board and having a plurality of radiating elements extending away from the front face, a back plate having a back wall including one or more first interior walls defining one or more openings receiving the one or more radiating elements, and having side wall having at least one latch, and a second wall defining at least in part an opening to receive the electrical connector, thereby forming a socket portion;

an optic coupled to the printed circuit board, the optic having a light receiving face positioned to substantially intersect light emitted from the one or more LEDs, the optic having a portion mechanically coupled intermediate the circuit board and the heat sink; the optic being a body of revolution having a side wall with at least a portion of the side wall being reflective, wherein the optic is made of metal, and has a thermal contact pressed against the either printed circuit board or the heat sink; the optic being made of metal, and having a portion intermediate the printed circuit board and the heat sink; wherein the heat sink is a linearly extended body having a planar surface on a first side and a plurality of ribs extending from a second side perpendicularly opposite to the first side, the heat sink otherwise having a constant cross section having a first perpendicular end and a second perpendicular end; and a front plate having a front face, an inner wall defining a passage and a latch;

the back plate being latched to the front plate, trapping the circuit board in close thermal contact with the front face of the heat sink, with the at least one radiating element extended through the back plate and exposed on the exterior of the lamp assembly.

* * * * *